US012638020B1

(12) United States Patent
Yehl et al.

(10) Patent No.: US 12,638,020 B1
(45) Date of Patent: May 26, 2026

(54) FLUID PUMP INCLUDING AN IMPELLER

(71) Applicant: ITT Manufacturing Enterprises LLC, Wilimington, DE (US)

(72) Inventors: Patrick J. Yehl, Victor, NY (US); John Wilkie, Seneca Falls, NY (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 0 days.

(21) Appl. No.: 19/118,195

(22) PCT Filed: Oct. 28, 2022

(86) PCT No.: PCT/US2022/048139

§ 371 (c)(1),
(2) Date: Apr. 3, 2025

(87) PCT Pub. No.: WO2024/091245

PCT Pub. Date: May 2, 2024

(51) Int. Cl.
*F04D 29/22* (2006.01)
*F04D 29/42* (2006.01)

(52) U.S. Cl.
CPC ..... *F04D 29/22* (2013.01); *F04D 29/2266* (2013.01); *F04D 29/426* (2013.01)

(58) Field of Classification Search
CPC ..... F04D 29/22; F04D 29/426; F04D 29/2266
See application file for complete search history.

(56) References Cited

U.S. PATENT DOCUMENTS 4,867,633 A * 9/1989 Gravelle ..... F04D 29/167 415/113
5,156,522 A * 10/1992 Tessier ..... F04D 29/445 415/58.4
5,542,817 A * 8/1996 Brandt ..... F04D 29/2288 415/106
7,326,029 B2 * 2/2008 Ahlroth ..... F04D 29/2266 415/106
11,268,533 B2 * 3/2022 Loderer ..... F04D 7/045
2006/0263200 A1 11/2006 Ahlroth et al.
2017/0218970 A1 8/2017 Ahlroth et al.
2018/0172017 A1 6/2018 Loderer et al.

OTHER PUBLICATIONS

International Search Report and Written Opinion issued in International Patent Application No. PCT/US2022/048139 dated Feb. 8, 2023 (10 pages).

* cited by examiner

*Primary Examiner* — Eldon T Brockman
(74) *Attorney, Agent, or Firm* — Carter, DeLuca & Farrell, LLP; Bret P. Shapiro

(57) ABSTRACT

An impeller assembly including: an impeller housing having a housing inlet and a housing outlet for receiving and discharging working fluid; and an impeller located within and rotatable with respect to the impeller housing. The impeller having an impeller inlet for receiving the working fluid, a plurality of impeller blades forming a plurality of impeller passageways in communication with the impeller inlet, and a plurality of impeller outlets each communicating with one of the impeller passageways for discharging the working fluid. The impeller includes an impeller hub that has one or more hub vanes forming hub fluid channels to receive secondary fluid, where the hub fluid channels are in communication with at least one of the plurality of impeller passageways and is configured to induce rotation of the impeller hub. Angled hub vanes and/or skewed directional thrust balance openings are configured to induce rotation of the impeller hub.

20 Claims, 13 Drawing Sheets

FLUID PUMP INCLUDING AN IMPELLER

CROSS-REFERENCE TO RELATED APPLICATIONS

This application is a National Stage Application under 35 U.S.C. § 371(a) of PCT/US2022/048139, filed on Oct. 28, 2022 entitled: "FLUID PUMP INCLUDING AN IMPELLER". The entire contents of which are incorporated by reference herein.

BACKGROUND

The present application relates generally to an improved pump and more specifically an improved impeller design for pumping fluids and the like.

Generally, in a pump utilizing an impeller design, fluid enters a rotating impeller along its axis and the fluid is discharged by centrifugal force along its circumference through the impeller's blade tips. The action of the impeller increases the fluid's velocity and pressure and preferably also directs the fluid toward the pump housing or casing outlet.

It would be advantageous to increase the efficiency of the impeller pump, including for example utilizing an impeller design that will rotate more easily and decrease the amount of power required to rotate the impeller and create pressure.

SUMMARY

The summary of the disclosure is given to aid understanding of pumps, including impeller-based pumps that include impeller assemblies and the like, and not with an intent to limit the disclosure or the invention. The present disclosure is directed to a person of ordinary skill in the art. It should be understood that various aspects and features of the disclosure may advantageously be used separately in some instances, or in combination with other aspects and features of the disclosure in other instances. Accordingly, variations and modifications may be made to the impeller assembly and design to achieve different effects.

A pump assembly using an impeller for pumping fluids is disclosed. In one or more approaches an impeller assembly is disclosed that includes: an impeller housing having a housing inlet for receiving a working fluid and a housing outlet for discharging the working fluid; and an impeller located within the impeller housing and configured to rotate relative to the impeller housing, the impeller having an impeller inlet for receiving the working fluid, a plurality of impeller blades forming a plurality of impeller passageways in communication with the impeller inlet to receive the working fluid, and each of the plurality of impeller passageways have an impeller outlet for discharging the working fluid, wherein the impeller further comprises an impeller hub that has one or more hub vanes forming one or more hub fluid channels to receive secondary fluid, wherein at least one of the one or more hub fluid channels is configured to induce rotation of the impeller. In one or more aspects the impeller assembly comprises at least one of the one or more hub vanes being angled relative to a hub longitudinal axis and/or one or more angularly oriented directional thrust balance openings to induce rotation of the impeller. In an embodiment, one of, a plurality of, or all of the hub vanes are angled, preferably at an angle of between ten (10) degrees and thirty (30) degrees, and in an aspect extend a length of the impeller hub. In an approach, a plurality of angled hub vanes are configured together with the one or more hub fluid channels so that the secondary fluid flows through the one or more hub fluid channels in a manner to facilitate rotating the impeller relative to the impeller housing. Alternatively or additionally, one or more angularly oriented directional thrust balance openings are configured with respect to the hub fluid channels to facilitate rotating the impeller relative to the impeller housing.

The one or more hub fluid channels in an embodiment are in communication with at least one of the plurality of impeller passageways, and in a further aspect each one of the one or more hub fluid channels are in communication with at least a respective single one of the plurality of impeller passageways. In an alternative embodiment, multiple hub fluid channels are in communication with a single one of the plurality of impeller passageways. The one or more hub vanes in one or more arrangements strengthen the impeller hub. In a further embodiment, the one or more hub fluid channels each include a directional thrust balance opening to direct the secondary fluid into at least one of a group consisting of: at least one of the plurality of impeller passageways, an impeller housing chamber, and combinations thereof. The at least one of the directional thrust balance openings is, according to an embodiment, angularly oriented, preferably at an angle between 5 and 45 degrees, and in communication with at least one of the plurality of impeller passageways. The at least one angularly oriented directional thrust balance opening in an approach is located in an end wall of the impeller hub in communication with one of the plurality of impeller passageways, and in a further aspect is at least one of a group consisting of a slot having a width and a length, a round hole having a diameter, and combinations thereof. The at least one angularly oriented directional thrust balance opening according to an embodiment has an angular orientation that substantially matches an angular orientation of the at least one of the one or more angled hub vanes, and in a further aspect the at least one angularly oriented directional thrust balance opening is located adjacent an interior hub wall of the impeller hub. The plurality of hub fluid channels in a further aspect is the same number as the plurality of impeller passageways.

The impeller assembly in an embodiment further includes at least one of a group to provide the secondary fluid to the one or more hub fluid channels, wherein the group consisting of: a flush circuit, an external passage, an outside passage, an internal passage; or combinations thereof. The secondary fluid according to a further aspect includes a portion of the working fluid. The flush circuit according to an arrangement receives at least a portion of the secondary fluid from at least one of a group consisting of: one or more of the impeller outlets, an impeller housing chamber, and combinations thereof, and provides the secondary fluid to the one or more hub fluid channels. The flush circuit in an embodiment provides the secondary fluid to an interface between the impeller hub and one or more stationary components of the impeller assembly. The secondary fluid according to an approach is provided to at least one of a group consisting of: one or more hub fluid channel entrances, along the length L of the one or more hub fluid channels, through an interior hub wall, through an exterior hub wall, and combinations thereof. The impeller assembly according to an embodiment, further includes a shaft configured to support the impeller hub for rotation and the angled hub vanes extend in the direction of an axis of rotation associated with the shaft. The impeller receives torque to rotate the impeller relative to the impeller housing.

An impeller assembly is disclosed according to a further embodiment that includes: an impeller housing having a housing inlet for receiving a working fluid and an impeller outlet for discharging the fluid; and an impeller located within the impeller housing and configured to rotate relative to the impeller housing, the impeller having an impeller inlet for receiving the working fluid and a plurality of impeller blades forming a plurality of impeller passageways to receive the working fluid, wherein the impeller inlet is in communication with the plurality of impeller passageways and each of the plurality of impeller passageways have an impeller outlet for discharging the working fluid. The impeller further includes an impeller hub that has one or more hub vanes forming one or more hub fluid channels to receive secondary fluid and the one or more hub fluid channels are in communication with at least one of the plurality of impeller passageways and at least one of the hub fluid channels is configured to induce rotation of the impeller. The one or more hub fluid channels preferably comprises at least one directional thrust balance opening configured to direct the secondary fluid into at least one of a group consisting of: at least one of the plurality of impeller passageways, an impeller housing chamber, and combinations The at least one directional thrust balance opening in an aspect is angularly oriented with respect to at least one of the plurality of impeller passageways. The at least one angularly oriented directional thrust balance opening is configured according to an arrangement in an end wall of the impeller hub and in communication with at least one of the plurality of impeller passageways. The at least one angularly oriented directional thrust balance opening comprises at plurality of angularly oriented directional thrust balance openings that are angularly oriented with respect to each respective impeller passageway that the angularly oriented directional thrust balance opening communicates. In a further aspect, the impeller assembly includes at least one of the one or more hub vanes extends the length of the impeller hub and is angled relative to a hub longitudinal axis.

The foregoing and other objects, features and advantages of the invention will be apparent from the following more particular descriptions of exemplary embodiments of the invention as illustrated in the accompanying drawings.

BRIEF DESCRIPTION OF THE DRAWINGS

The various aspects, features, and embodiments of the methods, techniques, products, assemblies, and/or systems for pumping fluids, including a pump having an improved impeller assembly and impeller design for pumping fluids, will be better understood when read in conjunction with the figures provided. It may be noted that a numbered element in the figures is typically numbered according to the figure in which the element is introduced, is typically referred to by that number throughout succeeding figures, and that like reference numbers generally represent like parts of exemplary embodiments of the invention.

Embodiments are provided in the figures for the purpose of illustrating aspects, features, and/or various embodiments of the methods, techniques, products, assemblies, and/or systems for pumping fluids, including pumps incorporating an impeller assembly and/or impeller design, but the claims should not be limited to the precise arrangement, configuration, structures, features, aspects, assemblies, subassemblies, systems, embodiments, approaches, methods, processes, or devices shown. The arrangements, configuration, structures, features, aspects, assemblies, subassemblies, systems, embodiments, approaches, methods, processes, and/or devices shown may be used singularly or in combination with other arrangements, configurations, structures, features, aspects, assemblies, subassemblies, systems, embodiments, approaches, methods, processes, and/or devices.

DETAILED DESCRIPTION

The following description is made for illustrating the principles of the invention and is not meant to limit the inventive concepts claimed herein. In the following detailed description, numerous details are set forth in order to provide an understanding of methods, techniques, pumps, pump assemblies, and/or pump systems for pumping fluids, containing, for example, an impeller, however, it will be understood by those skilled in the art that different and numerous embodiments of the methods, techniques, products, assemblies, pumps, and/or systems may be practiced without those specific details, and the claims and disclosure should not be limited to the arrangements, configurations, embodiments, features, aspects, assemblies, subassemblies, structures, processes, methods, or details specifically described and shown herein. In addition, features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It should also be noted that, as used in the specification and the appended claims, the singular forms "a", "an" and "the" include plural referents unless otherwise specified, and that the terms "includes", "including", "comprises", and/or "comprising," when used in this specification, specify the presence of stated features, integers, steps, operations, elements, and/or components, but do not preclude the presence or addition of one or more other features, integers, steps, operations, elements, components, and/or groups thereof.

The following discussion omits or only briefly describes pump assemblies having impeller designs, which are apparent to those skilled in the art. It is assumed that those skilled in the art are familiar with pumps for pumping fluids, including impeller systems, assemblies, and designs, including appropriate dimensions, configurations and materials for pumping fluids, displacing various amounts of fluid, and/or generating various fluid flow rates.

Figure 1:
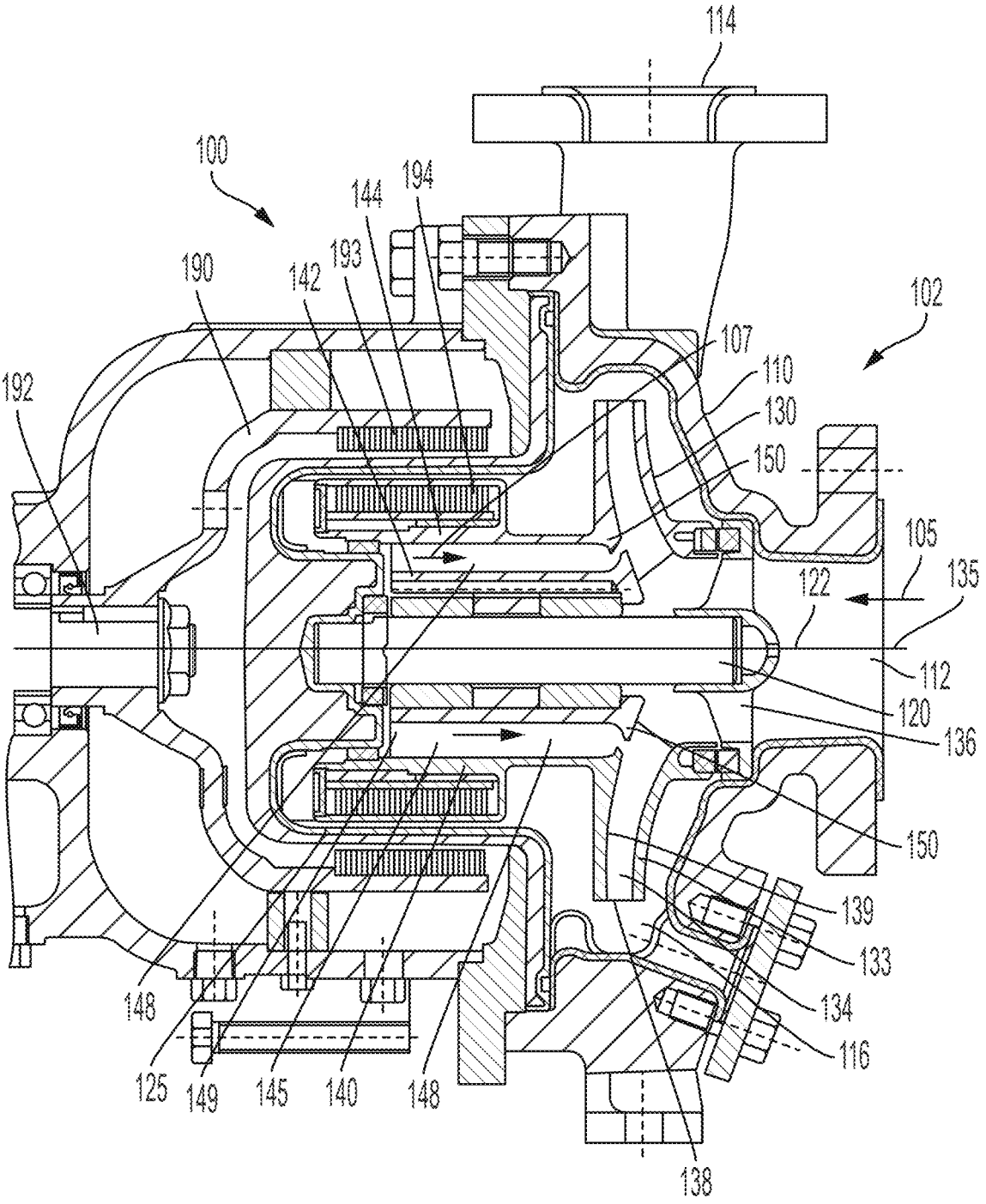
FIG. 1 is a side cross-sectional view of an impeller portion of a pump assembly that comprises an impeller assembly and design according to an embodiment of the present disclosure.
Figure 2:
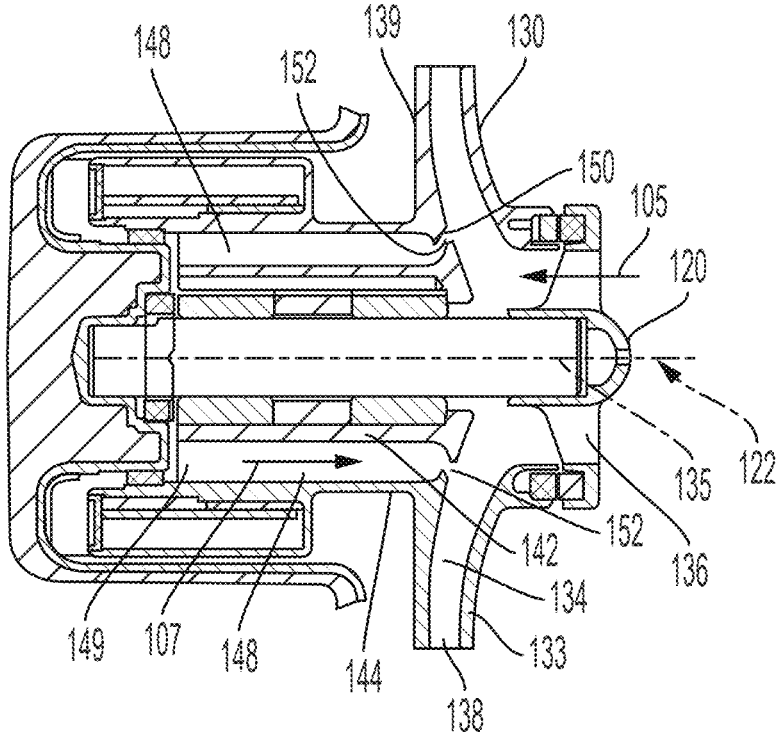
FIG. 2 is a side cross-sectional view of a different embodiment of an impeller assembly for use in the pump assembly of FIG. 1 according to an embodiment of the present disclosure.

FIGS. 1-11 illustrate various views and embodiments of a pump assembly, including an impeller and portions of an impeller for use in a pump assembly. FIG. 1 illustrates a side cross-sectional view of a portion of a pump assembly or system 100 for pumping fluid, while FIG. 2 illustrates a side cross-sectional view of an embodiment of a portion of an impeller assembly 102 used in the pump assembly 100. Pump assembly 100 includes a pump casing or housing 110 and an impeller 130. Impeller 110 is contained within the pump housing 110 and rotates relative to the pump housing 110 about a shaft 120, which has a longitudinal axis 122. Shaft 120 preferably is stationary, and in an embodiment is fixed with respect to the pump housing 110. Torque is applied to the impeller 130 to rotate impeller 130 within housing 110 about shaft 120. Torque can be applied to the impeller in numerous different manners and by numerous different mechanisms. The pump housing 110 has a fluid inlet 112 for receiving working fluid 105 and a fluid outlet 114 to discharge the working fluid 105. The working fluid 105 preferably exits the pump housing outlet 114 with greater velocity and pressure than the working fluid 105 enters the pump housing inlet 112.

Impeller 130 contains a plurality of impeller or hydraulic blades 132 that form a plurality of impeller passageways 134. Working fluid 105 received by the housing fluid inlet 112 enters impeller inlet 136 axially along a longitudinal axis 135 of the impeller 130, which preferably coincides with the longitudinal axis 122 of the shaft 120. Impeller inlet 136 is in communication with a plurality of impeller passageways 134 and working fluid 105 entering impeller inlet 136 flows to and within the plurality of impeller passageways 134. Impeller 130 has a plurality of impeller outlets 138 that communicate with the plurality of impeller passageways 134. Impeller blades 132 form the impeller passageways 134 and the impeller blades 132 are configured and shaped (e.g., curved) such that working fluid 105 enters the impeller inlet 136 axially (i.e., along the direction of the impeller longitudinal axis 135), flows through the plurality of impeller passageways 134, and exits the impeller outlets 138 circumferentially (e.g., offset from and in a direction tangential to a longitudinal axis 135 of the impeller 130).

The impeller blades 132 preferably curve outward from the center to the periphery of the impeller 130. Each impeller passageway 134 is preferably formed by two impeller blades 132, and in addition an impeller front wall 133 and an impeller back wall 139. Preferably the working fluid 105 that exits the impeller outlets 138 is directed toward the pump housing outlet 114, and in an embodiment the plurality of impeller outlets 138 communicate with a chamber 116 formed in the pump housing 110. The chamber 116 communicates with the housing outlet 114 such that the working fluid 105 exits the impeller outlets 138 into chamber 116 and/or housing outlet 114. As a result of the centrifugal force on the working fluid 105 exiting the impeller outlets 138 because of the rotation of the impeller 130, the pressure at the impeller outlets 138 and housing chamber 116 is higher than the impeller inlet 136.

Figure 3:
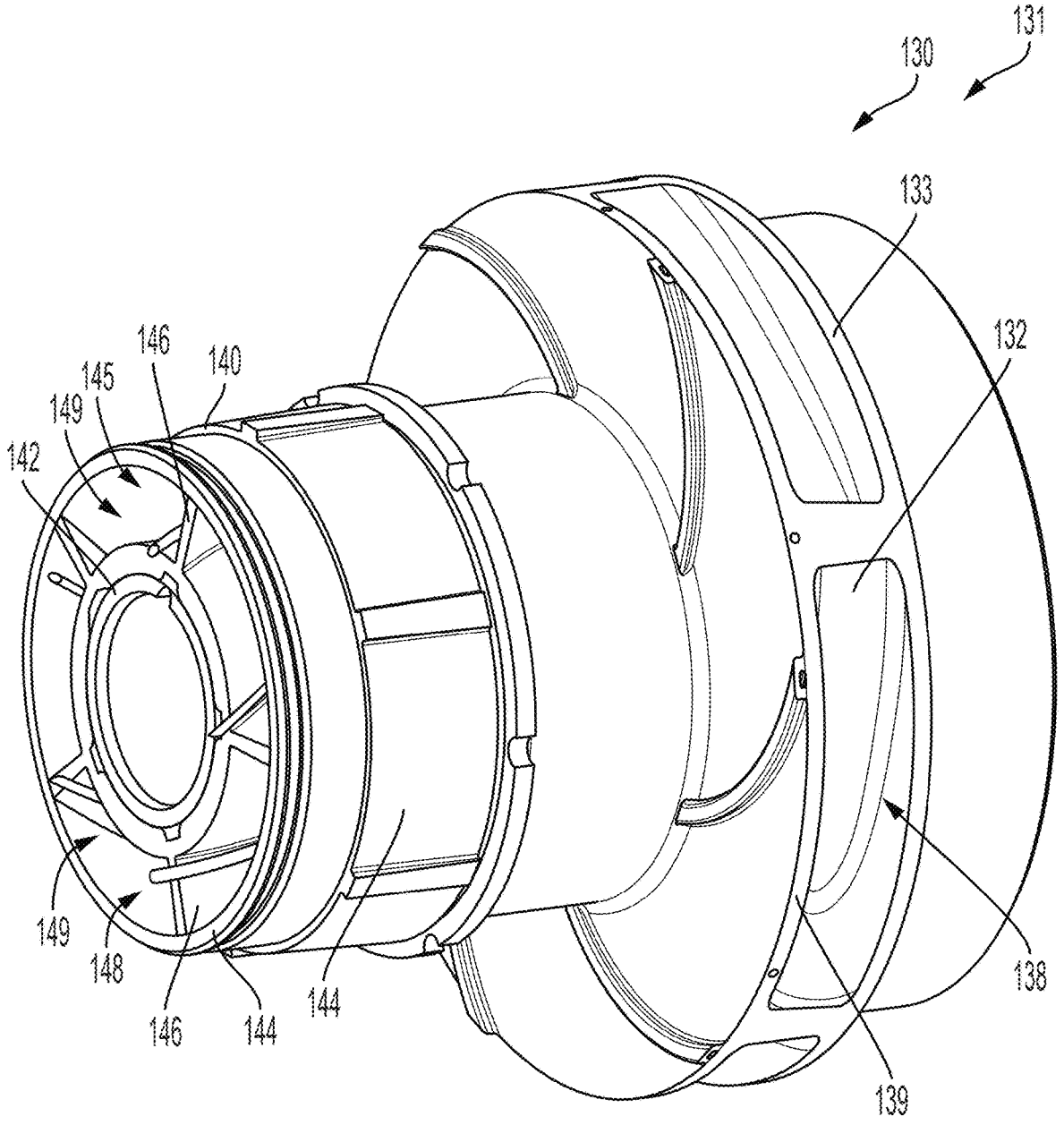
FIG. 3 is a side perspective view of an impeller, according to an embodiment of the present disclosure.
Figure 4:
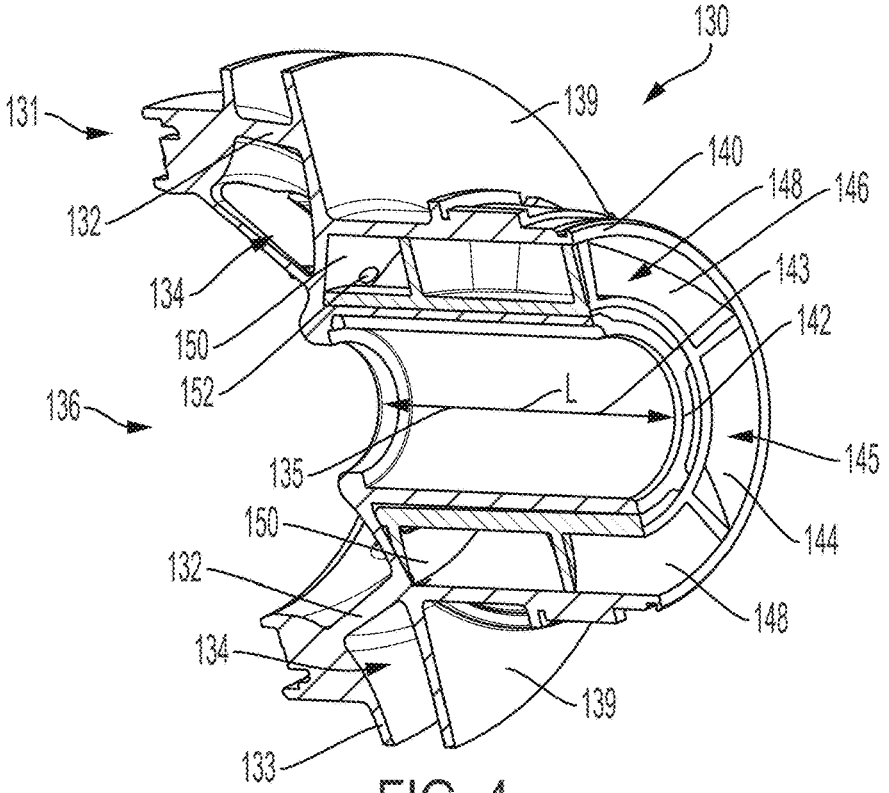
FIG. 4 is a side perspective cross-sectional view of an impeller, according to an embodiment of the present disclosure.
Figure 5:
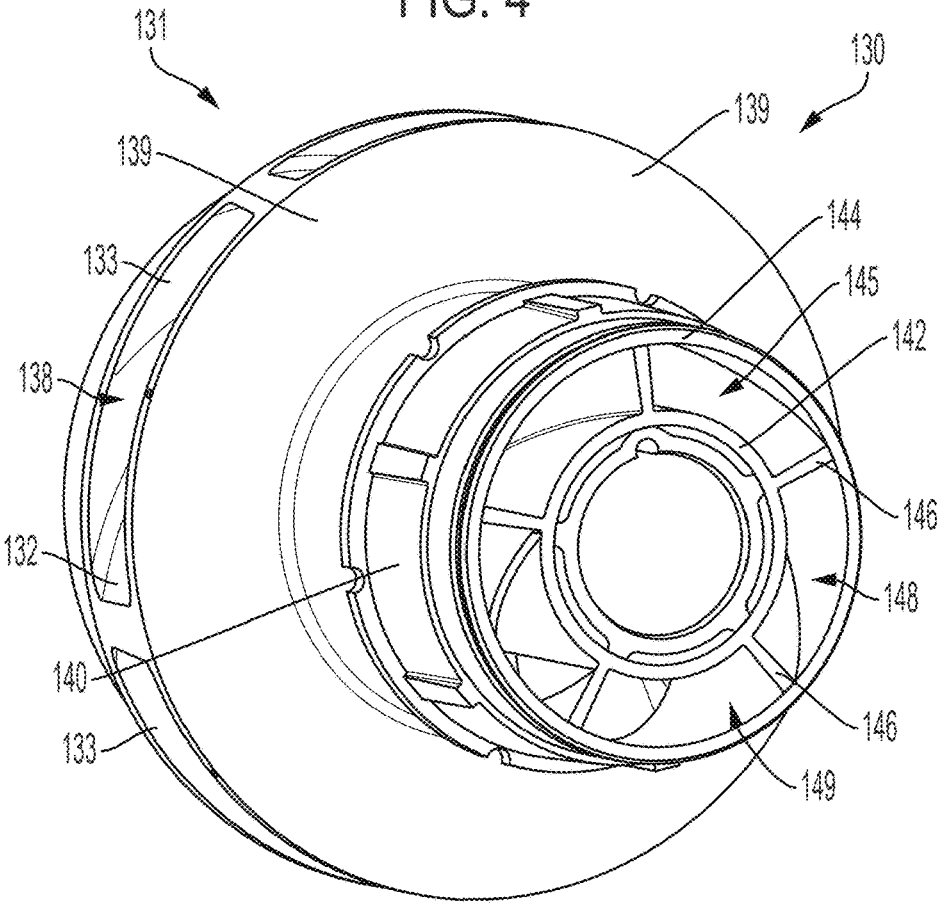
FIG. 5 is a back perspective view of the impeller of FIG. 4, according to an embodiment of the present disclosure.

Impeller 130 includes an impeller hub 140 that receives and is supported by and/or on the impeller shaft 120. FIG. 3 shows a side perspective view of an impeller, FIG. 4 shows a side perspective cross-sectional view of the impeller 130 including the impeller hub 140, and FIG. 5 shows a back perspective view of the impeller 130 including impeller hub 140. Impeller hub 140, as shown in FIGS. 3-5, extends in an axial direction from the impeller portion 131 of the impeller 130, where the impeller portion 131 includes the impeller blades 132 and the plurality of impeller passageways 134. The impeller hub 140 has a length L that extends along hub longitudinal axis 143, which is in the same direction as and coincident with the impeller shaft 120 and the shaft longitudinal axis 122.

More specifically, in an embodiment, impeller hub 140 includes an interior wall 142 that is supported on impeller shaft 120, for example by bushings. Impeller hub 140 has an exterior wall 144 and there is a space 145 between the interior hub wall 142 and exterior hub wall 144. One or more hub vanes 146 are configured in the space 145 and extend between the interior hub wall 142 and the exterior hub wall 144. The vane hubs 146 are used as support for the impeller hub and strengthen and stiffen the impeller hub 140. It is contemplated that three to six hub vanes 146 will be used, however, it should be appreciated that the number of hub vanes 146 will vary depending upon the design.

Figure 6:
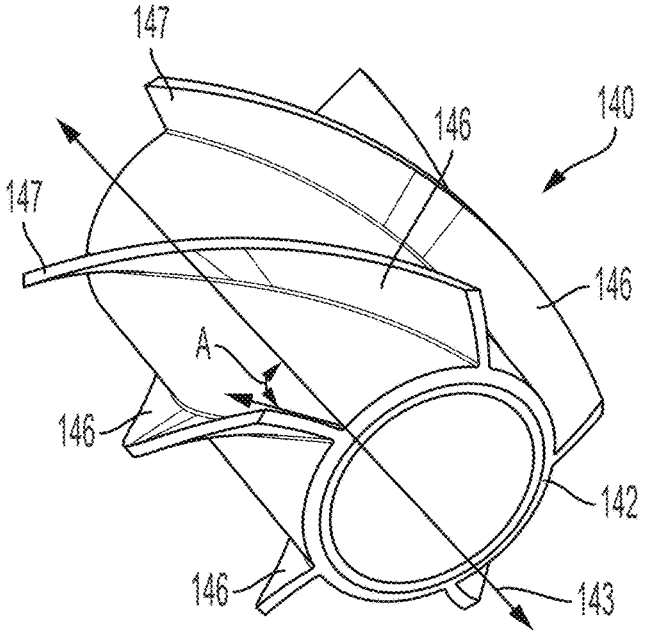
FIG. 6 is a back view of a portion of an impeller hub of an impeller, according to an embodiment of the present disclosure.

FIG. 6 shows a side perspective view of the impeller hub 140 of the impeller 130 with the exterior wall 144 removed to better illustrate the hub vanes 146. As shown in FIG. 6, the hub vanes 146 are twisted or curved as they extend along the length L of the impeller hub 140 along hub longitudinal axis 143. In other words, the hub vanes 146 twist about the length L of impeller hub 140 and have a pitch like a high pitch screw thread. That is, instead of being parallel with the hub axis 143, the hub vanes 146 are angled with respect to the hub longitudinal axis 143. The angular orientation or angle A of the hub vanes 146 with respect to the hub longitudinal axis 143 can vary, and in one or more embodiments it is contemplated that the angular orientation or pitch can be as low as 10 degrees and as high as 30 degrees, although other angular values are contemplated. In an embodiment the hub vanes 146 will have a reverse screw type geometry, preferably to assist in rotating the impeller 130 using directional fluid flow having a turbine effect.

The plurality of hub vanes 146 between hub interior wall 142 and hub exterior wall 144 form one or more, preferably a plurality of, hub fluid channels 148. Secondary fluid 107 flows down the plurality of hub fluid channels 148 and preferably contacts the plurality of hub vanes 146 to impart energy and/or force to the impeller hub 140 to facilitate rotation of the impeller 130. The reverse screw geometry or pitch of the hub vanes 146 preferably increases fluid flow down hub fluid channels 148 by drawing the fluid down the hub fluid channels 148. Each of the hub fluid channels 148 preferably has an entrance opening 149 to receive the secondary fluid 107. Opposite the openings 149 is an end wall 150 where the hub vanes 146 and the hub fluid channels 148 terminate or end. The hub fluid channels 148 preferably are in communication with one or more of the plurality of impeller passageways 134, and in an embodiment each of the hub fluid channels 148 is in communication with a respective one of the impeller passageways 134. One or more of the hub fluid channels 148 includes a directional thrust balance opening 152 in communication with one or more of the plurality of impeller passageways 134.

Figure 7:
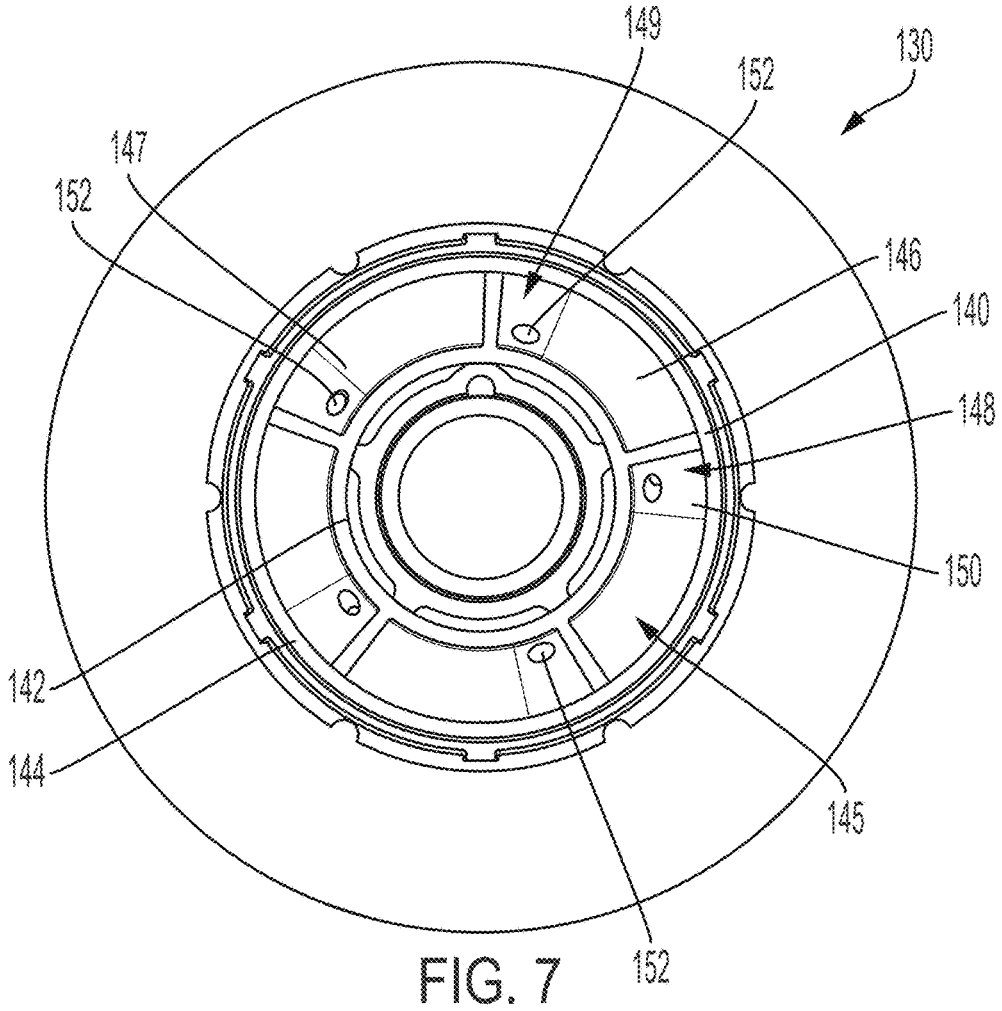
FIG. 7 is a back view of an impeller, according to another embodiment of the present disclosure.
Figure 8:
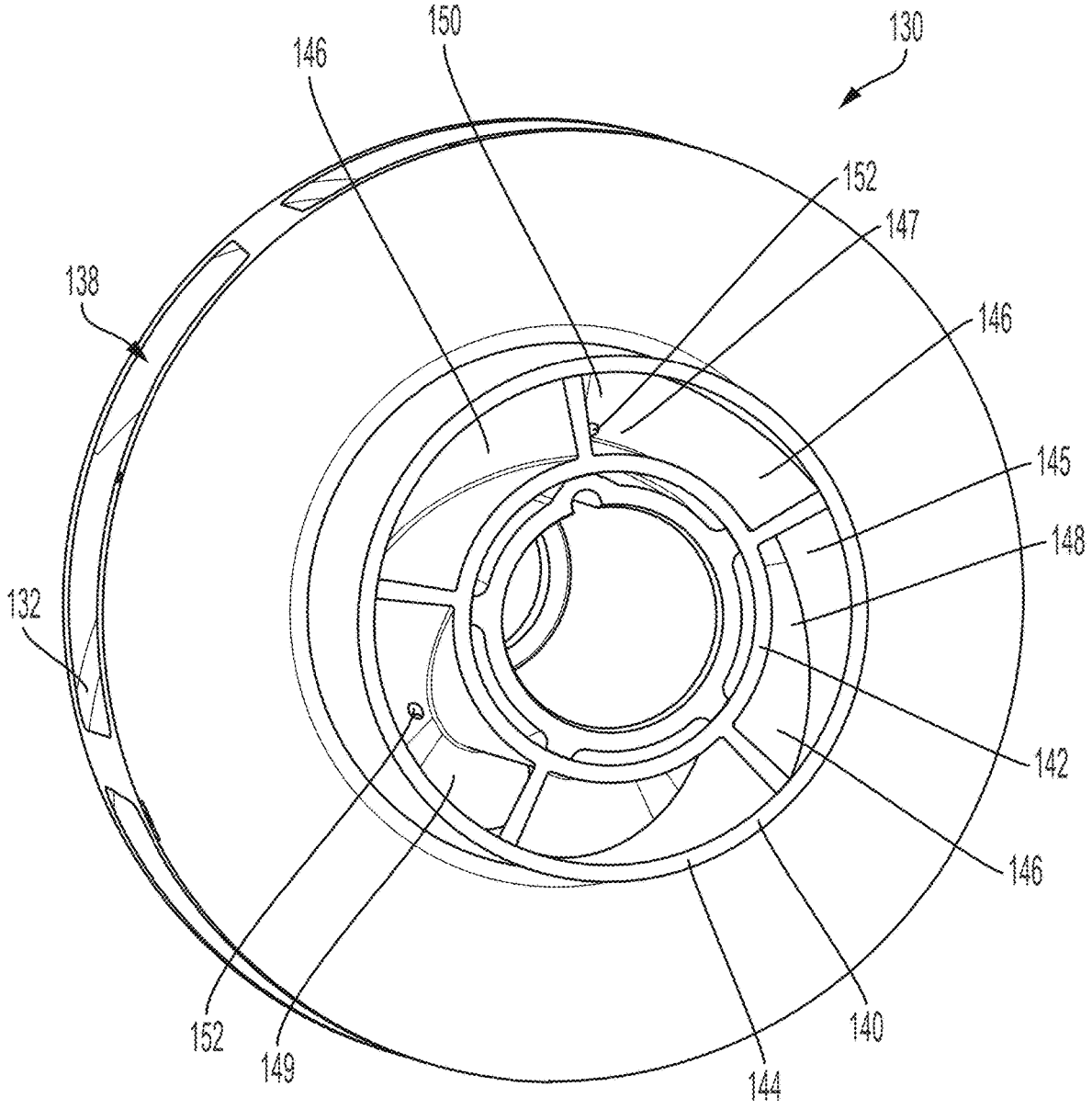
FIG. 8 is a back perspective view of the impeller, according to an embodiment of the present disclosure.
Figure 9:
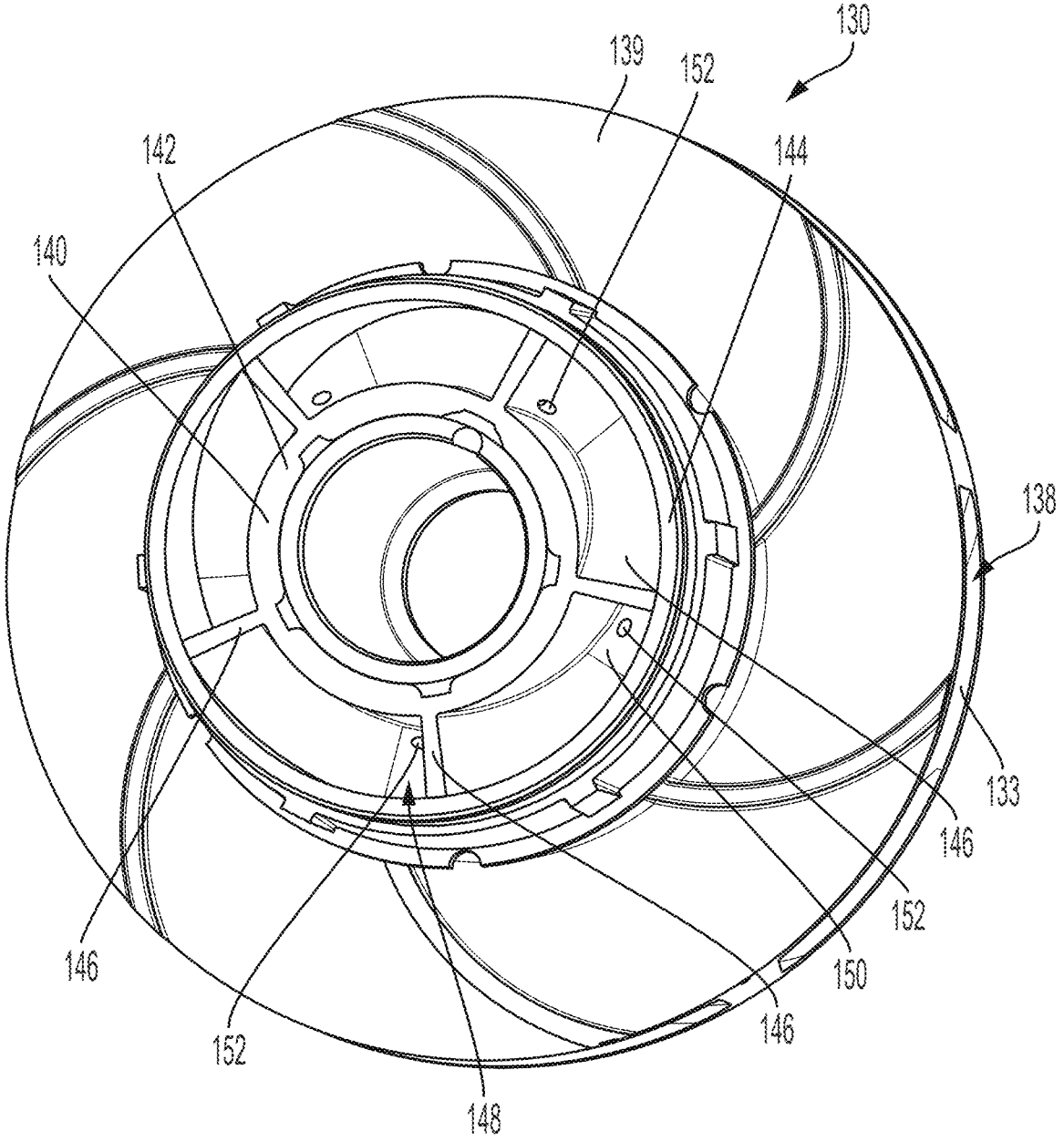
FIG. 9 is a back perspective view of an impeller, according to an embodiment of the present disclosure.

FIG. 7 illustrates a back elevation view of an embodiment of impeller 130 with its integrated hub 140, FIG. 8 shows a back perspective view of the impeller 130, and FIG. 9 shows a different back perspective view of the impeller 130. A directional thrust balance opening 152 preferably is provided in each of the one or more hub fluid channels 148, as shown in FIGS. 1-2, 4 and 7-9, to permit secondary fluid 107 to flow into impeller passageways 134. The directional thrust balance openings 152 preferably are formed in an end wall 150, and in an embodiment are formed adjacent the end 147 of each of the hub vanes 146 attached to the end wall 150. In an aspect, the directional thrust balance openings 152 can be located adjacent the interior hub wall 144, preferably so that secondary fluid 107 flows through the center of the impeller 130. The directional thrust balance openings 152 can take any form such as round holes, slots having a width and a length, other shapes, and combinations thereof. The directional thrust balance opening 152 in each hub fluid channel 148 can also comprise multiple directional thrust balance openings 152. In a preferred embodiment each directional thrust balance opening 152 is a round hole. The curved hub vanes 146 increases fluid flow by drawing the fluid into the hub fluid channels 148 and pushing the fluid through the directional thrust balance openings 152 to induce rotation of the impeller, which should increase the impeller efficiency.

Figure 10:
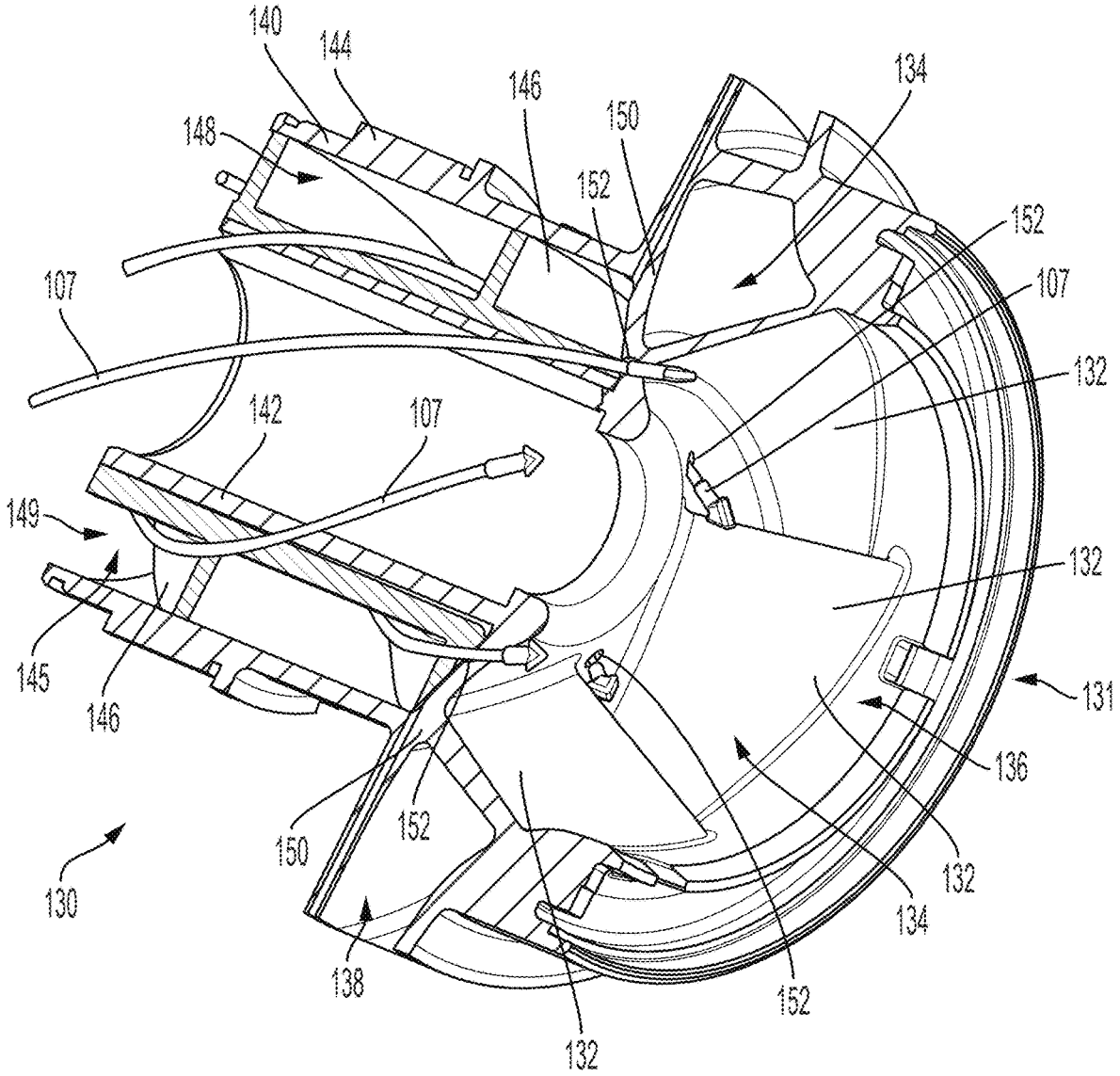
FIG. 10 is a front perspective cross-sectional view of an impeller, according to an embodiment of the present disclosure.

In an embodiment, secondary fluid 107 flows into one or more entrance openings 149 to one or more of hub fluid channels 148, flows through hub fluid channels 148 to the one or more directional thrust balance openings 152, flows through the one or more directional thrust balance openings 152 into the impeller passageways 134, and out of the impeller outlet 138. FIG. 10 illustrates a perspective cross-sectional view of the impeller 130 showing the flow of secondary fluid through entrance opening 149 into the hub fluid channels 148 where the secondary fluid 107 bears against the angularly oriented hub vanes 146 which imparts a rotational motion to the fluid and imparts rotational energy to the impeller hub 140 and impeller 130. The secondary fluid 107 as shown in FIG. 10 leaves the hub fluid channels 148 through the directional thrust balance openings 152 into the impeller passageways 134.

As illustrated in the one or more embodiments of the impeller designs of FIGS. 1-11, the hub fluid channels 148 are formed by the hub vanes 146, the hub interior wall 142, the hub exterior wall 144, and the hub end wall 150, however, other configurations, designs, and arrangements are contemplated for hub fluid channels 148. In addition, while directional thrust balance openings 152 to permit the secondary fluid 107 to flow into the impeller passageways 134 are shown in FIGS. 1-2, 4, 7-11 as being formed in the end wall 150, it can be appreciated that the directional thrust balance openings 152 can be configured differently, and can be formed and/or located in other locations in the impeller 130 and in the hub fluid channels 148.

Figure 11:
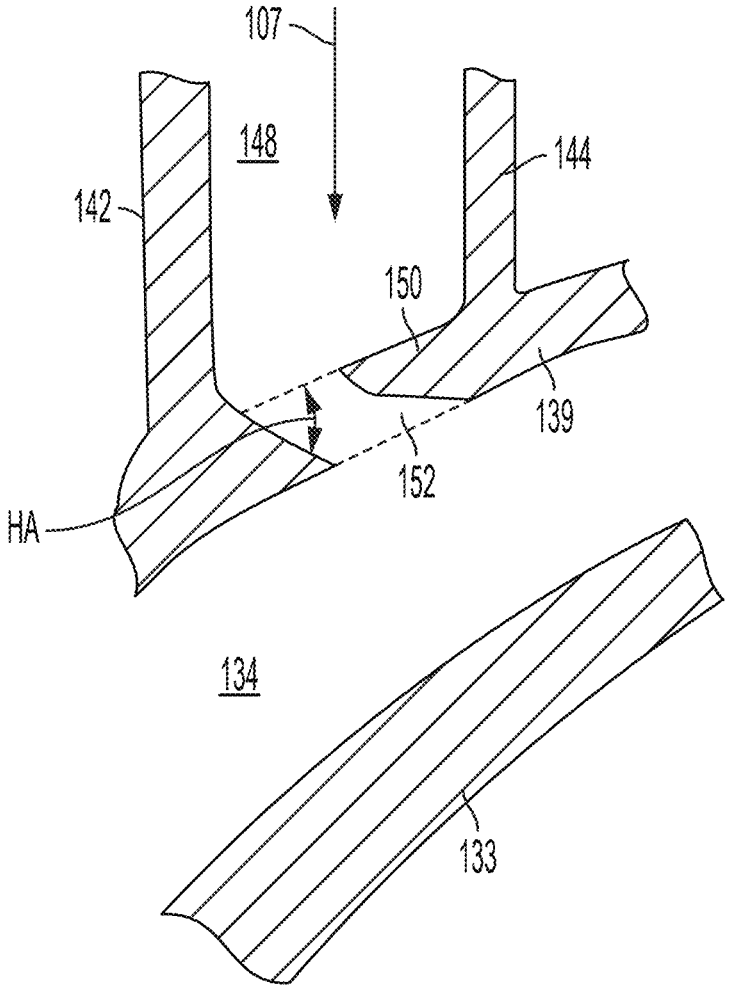
FIG. 11 is a cross-section view through a portion of a hub fluid channel illustrating a directional thrust balance opening, according to an embodiment of the present disclosure.

In one or more embodiments, the directional thrust balance openings 152 are also angularly oriented or skewed, preferably to induce fluid rotation at the impeller 130 to facilitate rotating the impeller 130. In an aspect, the directional thrust balance openings 152 are formed at an angle HA through hub end wall 150 of the impeller hub 140 as shown in FIG. 11. Angle HA preferably is the angle between the plane formed by the hub end wall 150 where the directional thrust balance opening 152 is located and the wall of the directional thrust balance opening 152 through the end wall 150. The angle HA formed by the directional thrust balance opening 152 can be any number of different angles, and in one or more embodiments the angle HA formed by the directional thrust balance openings 152 in the end wall 150 can be as high as sixty (60) degrees, but more preferably can be as low as five (5) degrees or as high as forty-five (45) degrees, although other angles are contemplated. It is contemplated that in an embodiment, the angle HA of the directional thrust balance opening 152 substantially matches the angle A of the angled hub vanes 146. It is contemplated that the directional thrust hole openings 152 can each have the same or different angles HA, and/or different pathways into the impeller passageways 134. The angularity of the directional thrust balance openings 152 assists with directing the secondary fluid 107 into the impeller passages 134 and preferably in a direction to push or propel the impeller 130 in its naturally rotating direction. The hub vanes 146 in an embodiment are formed by molding, preferably injection molding. That is, the geometry of the hub vanes 146 preferably is molded into the impeller 130 during the molding process.

It is contemplated that in an embodiment the number of hub fluid channels 148 will be of equal number with the number of impeller passageways 134, and that each hub fluid channel 148 will have one directional thrust balance opening 152 leading to one respective impeller passageway 134. It is also contemplated that in one or more embodiments, multiple directional thrust hole openings 152 will communicate with a single impeller passageway 134. That is, in one or more embodiment, multiple hub fluid channels 148 are formed to empty or discharge into a single impeller passageway 134 through multiple directional thrust hole openings 152 located at different locations within the single impeller passageway 134, where each hub fluid channel 148 preferably has at least one directional thrust hole opening 152. The geometry and configuration of the hub vanes 146 and/or the directional thrust balance openings 152, alone or in combination, can assist rotation of the impeller 130 through directional flow (e.g., rotation) with a turbine effect.

Figure 12:
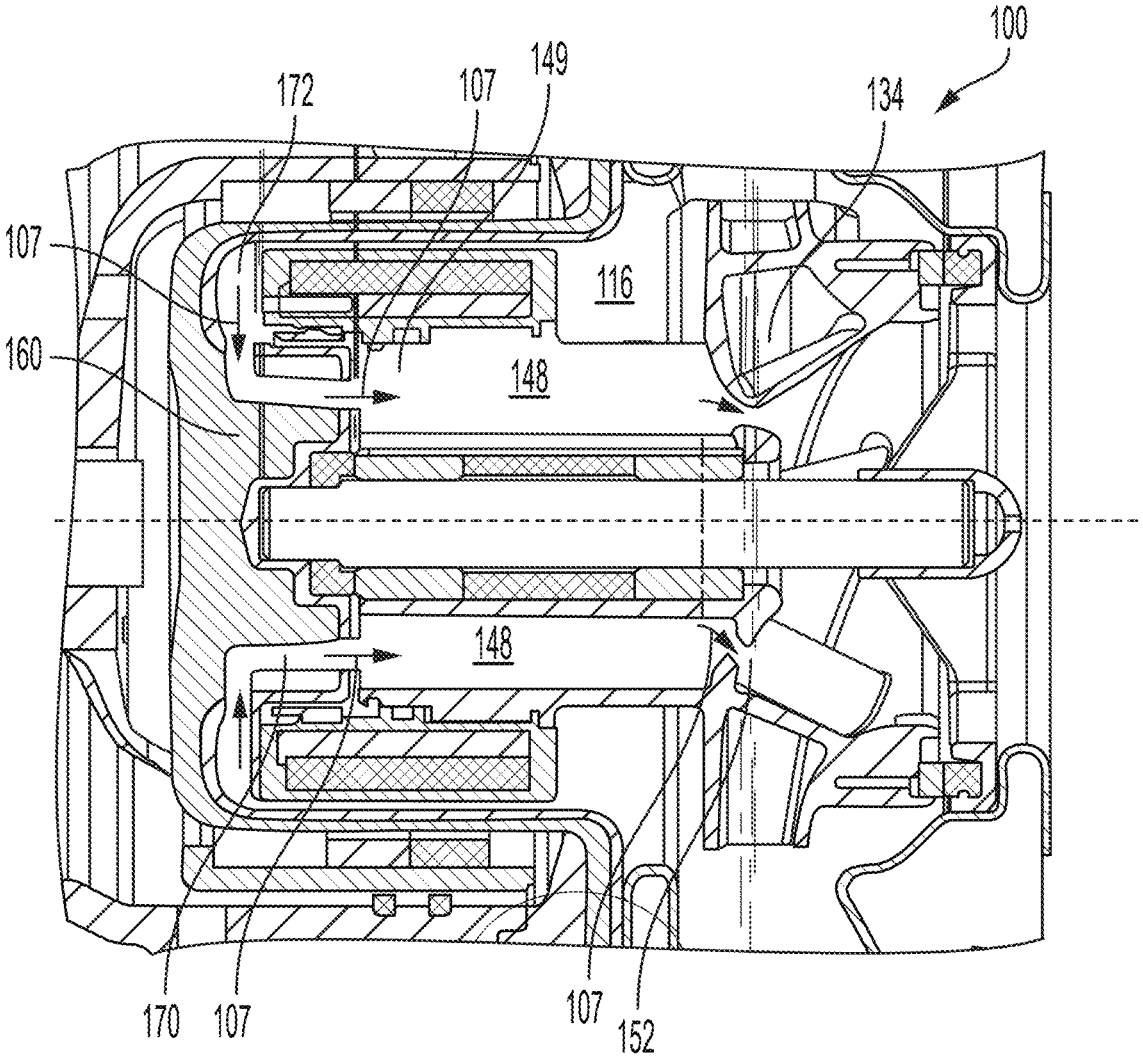
FIG. 12 is a cross-sectional view of a portion of a pump assembly showing an external passage to supply fluid to the plurality of hub fluid channels in an impeller, according to an embodiment of the present disclosure.
Figure 13:
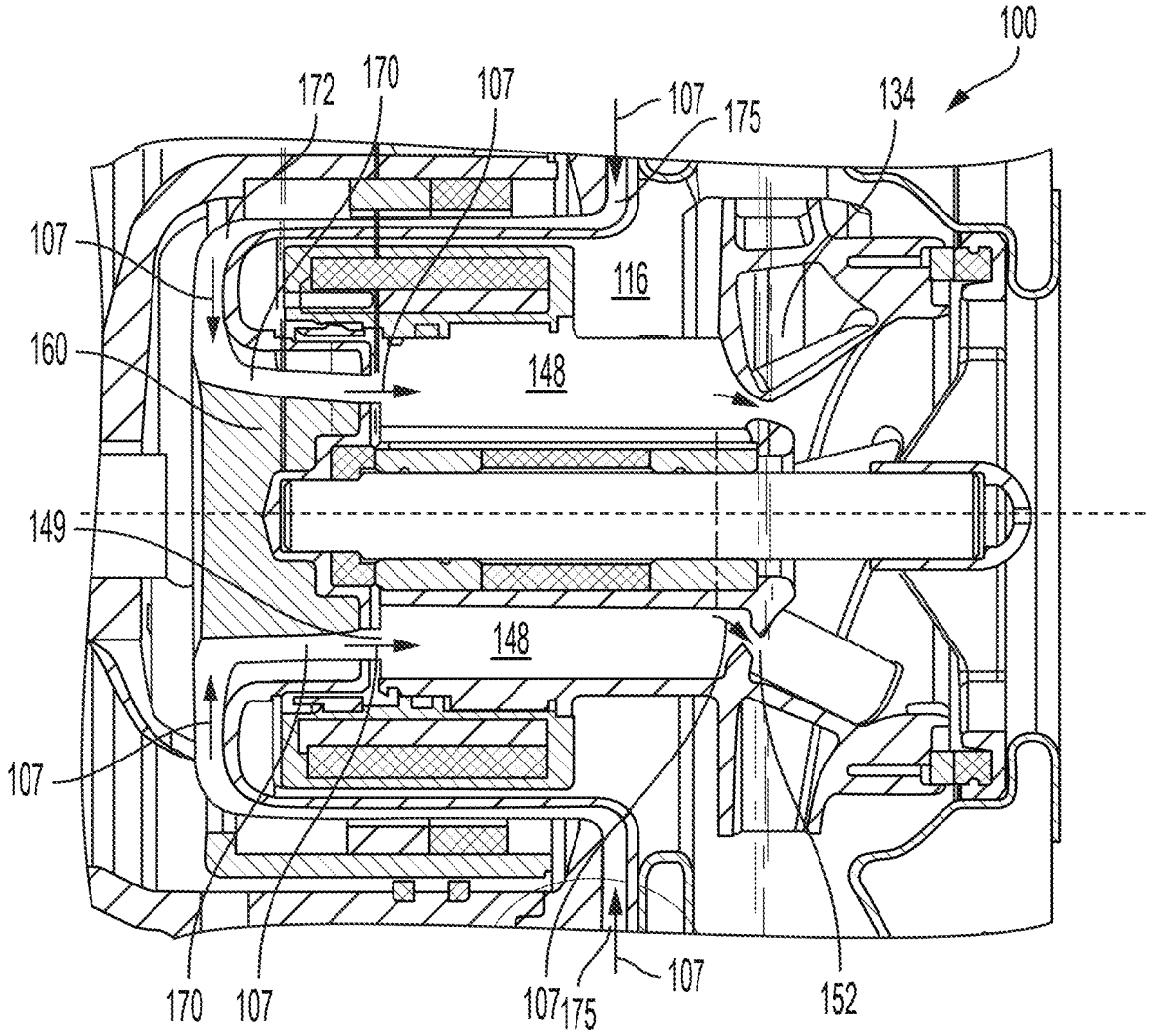
FIG. 13 is a cross-sectional view of a portion of a pump assembly showing a further embodiment of an external passage to supply fluid to the plurality of hub fluid channels in an impeller, according to an embodiment of the present disclosure.

Secondary fluid 107 can be delivered to hub channel entrance 149 in a plurality of different manners and by a plurality of different means. In one or more embodiments, fluid can be delivered to hub channel entrance 149 through: an external passage in a containment shell, an external passage in pump housing 110 in communication with an external passage in a containment shell, an internal passage in the containment shell, and/or by using an internal flush circuit. FIG. 12 illustrates a cross-section of a portion of pump 100 showing an external passage 170 through containment shell 160. Secondary fluid 107 flows through external passage 170 through containment shell 160 into hub fluid channels 148, and out of hub channels 148 through directional thrust holes 152. FIG. 13 illustrates a cross-section of a portion of pump assembly 100 showing an outside passage 175 to deliver secondary fluid 107 from outside of pump assembly 100 to an inside chamber 172. Inside chamber 172 communicates with external passage(s)

170 through containment shell 160 to deliver secondary fluid 107 through directional thrust balance openings 152 so that secondary fluid 107 is drawn into hub fluid channels 148. It is contemplated that in FIGS. 12-13, low pressure is created by working fluid 105 flowing through impeller passageways 134 to draw secondary fluid 107 into external passage 170 from inside chamber 172. The secondary fluid 107 is directed into the hub fluid channels 148 from external passage 170 where a turbine effect induces rotation of the impeller hub 140 because of the hub vanes 146 and the directional thrust balance openings 152, preferably the angled directional thrust balance openings 152.

Figure 14:
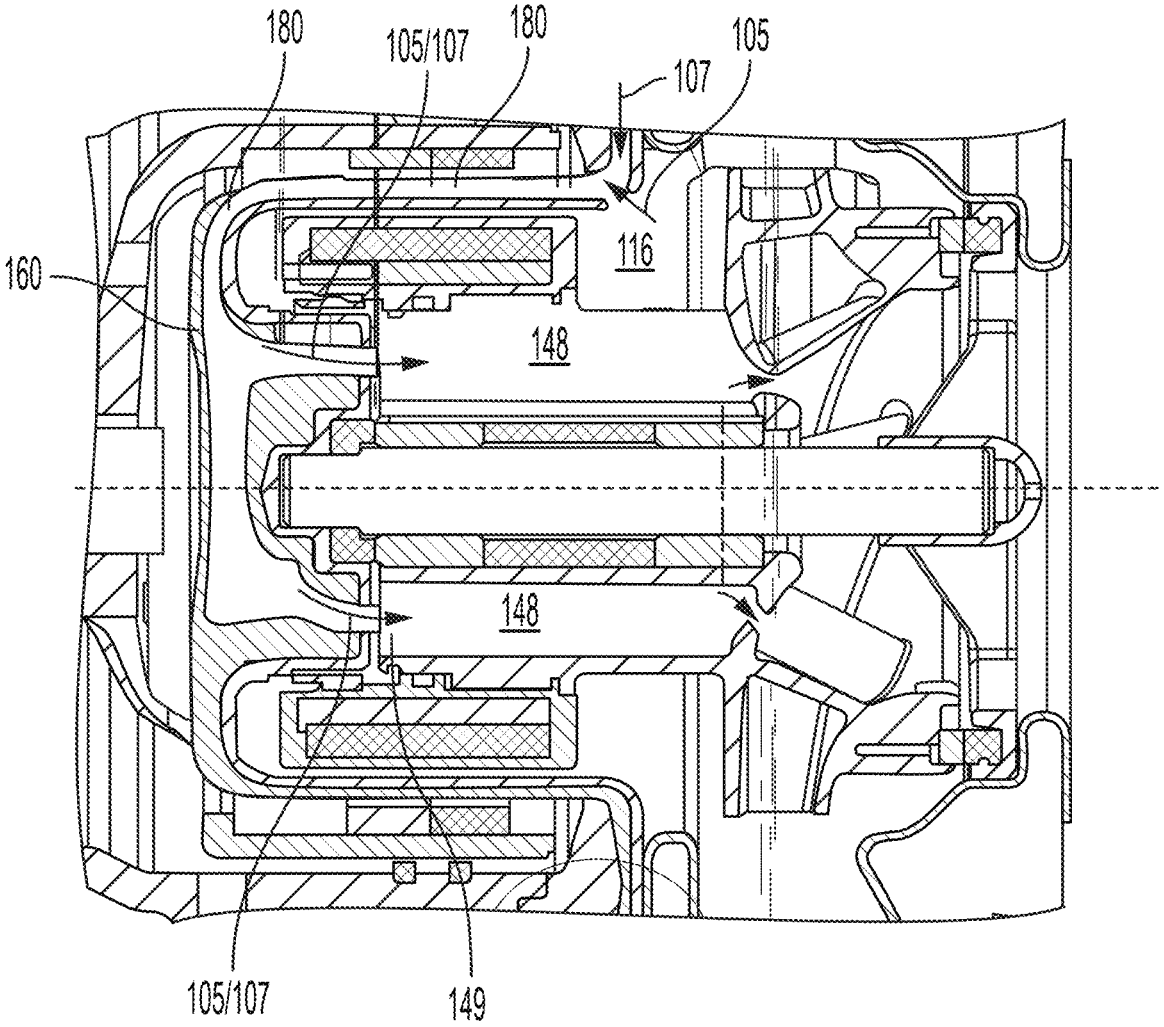
FIG. 14 is a cross-sectional view of a portion of a pump assembly showing an internal passage to supply fluid to the plurality of hub fluid channels in an impeller, according to an embodiment of the present disclosure.

FIG. 14 illustrates a cross-section of a portion of pump assembly 100 showing an internal passage 180 through the containment shell 160. In an example of FIG. 14, a volume (preferably small volume) of the working fluid 105 that is contained within the housing chamber 116 is supplied by an internal passage 180 into the hub fluid channels 148. In this example of FIG. 14 only working fluid 105 is supplied through the internal passage 180 to the hub fluid channels 148. In this approach of FIG. 14, working fluid 105 flows from the high-pressure side of impeller outlet 138 and/or housing chamber 116 to low pressure at the hub channel entrance 149 where the hub blades 146 are pushed by the working fluid 105 and expelled or discharged through directional thrust balance openings 152. Additionally, or alternatively, in another embodiment of FIG. 14 only secondary fluid 107, separate from the working fluid 105, supplied from outside pump assembly 100 is supplied through internal passage 180 through the containment shell 160 in the pump assembly 100. In a further embodiment of FIG. 14, both working fluid 105 (from the housing chamber 116 and/or impeller outlets 138) and secondary fluid 107 (e.g., separate from working fluid 105) can be supplied through internal passage 180 to the hub fluid channels 148. It can be further appreciated that the embodiment of FIG. 14 can use internal passage 180 with the embodiments of FIGS. 12-13 where an external passage 170 is also used to supply fluid into and down hub fluid channels 148.

Figure 15:
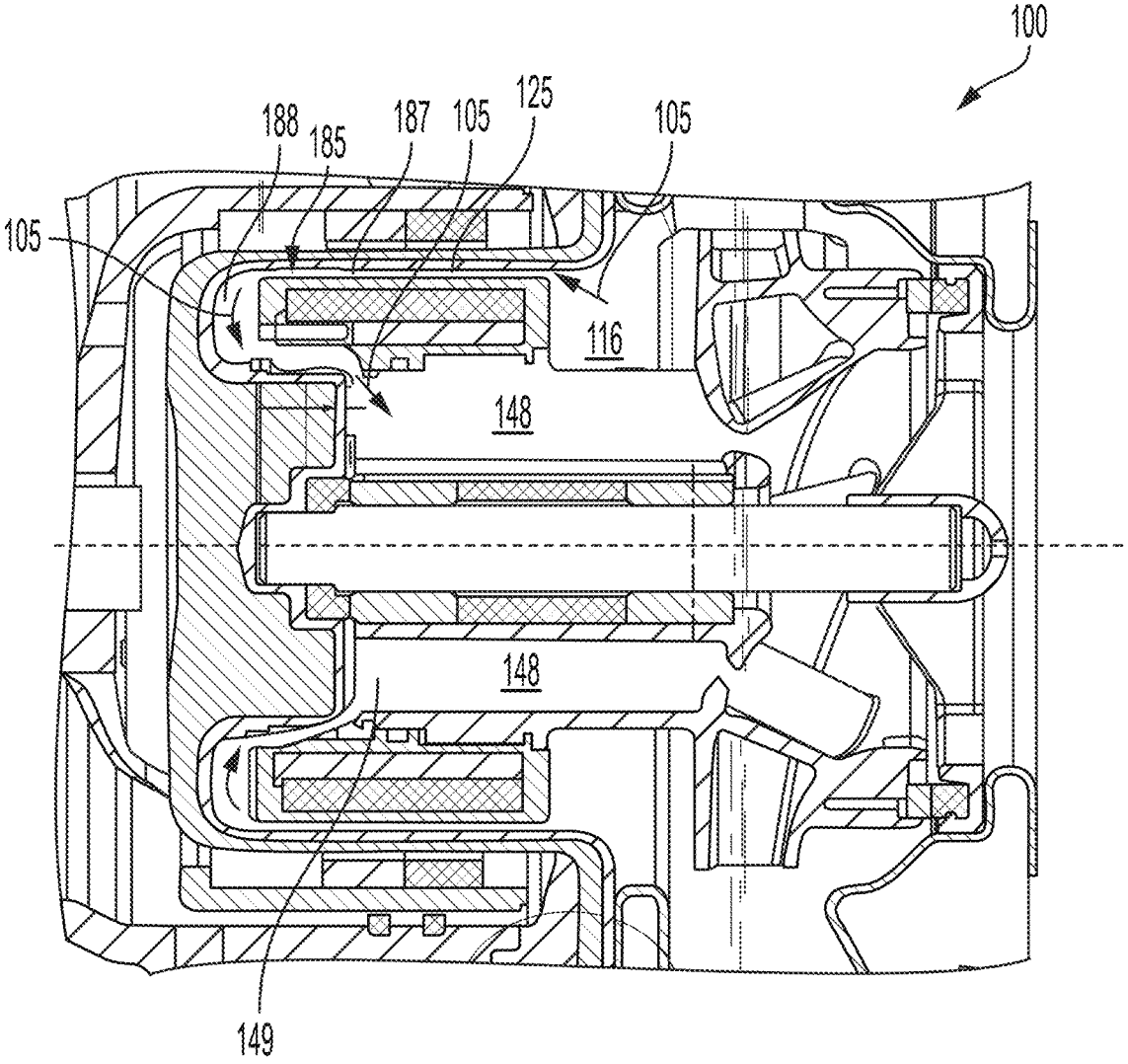
FIG. 15 is a cross-sectional view of a portion of a pump assembly showing a flush circuit to supply fluid to the plurality of hub fluid channels in an impeller, according to an embodiment of the present disclosure.

FIG. 15 illustrates a cross-section of a portion of a pump assembly 100 showing a flush circuit 185 for delivering fluid to the hub fluid channels 148. A flush circuit 185 delivers fluid between the containment shell 160 and the moving impeller 130, more specifically between stationary portions of the pump housing 110 and the rotating impeller hub 140 to clean debris and the like from the interface 125 between the rotating hub 140 and the stationary components of the pump housing 110. Flushing debris from the interface 125 maintains the ease at which the impeller 130 can rotate, particularly over time where particles and the like can increase friction at the interface 125 and resist rotation of the impeller 130. As shown in FIG. 15, flush circuit 185 starts at housing chamber 116 where a portion of working fluid 125 is drawn into flush passage 187 and flows through interface 125 and into flush chamber 188 where working fluid 105 flows into hub channel entrance 149 and into the plurality of hub fluid channels 148.

Working fluid 105 in the flush circuit 185 of FIG. 15 flows from the high pressure at impeller blade outlets 138 and housing chamber 116 into the flush passage 187 to low pressure at hub channel entrance 149 and the hub fluid channels 148. The twisted and/or curved hub blades 146 are pushed by working fluid 105 to rotate the impeller hub 140 as the working fluid 105 directionally flows down the hub fluid channels 148 with a turbine effect. That is, the geometry of the hub vanes 146 increase fluid flow by drawing fluid through the flush circuit 185, down the hub fluid channels 148 and out the skewed directional thrust balance openings 152. The working fluid 105 is expelled through the directional thrust balance openings 152 in the hub fluid channels 148. It can be appreciated that the flush circuit 185 discharges working fluid 105 into the fluid hub channels 148 and can be configured to discharge the working fluid 105 into the fluid hub channels 148 to induce rotation of the impeller hub 140. It can be appreciated that the embodiment of FIG. 15 using flush circuit 185 with flush passage 187 can be used with the embodiments of FIG. 14 using internal passage 180 and/or can be used with the embodiments of FIGS. 12-13 where an external passage 170 is used.

The flush circuit 185 shown and described in connection with FIG. 15 might be preferred as it uses portions of a flush circuit already used in some existing pump assemblies and directs the fluid to do the work of rotating the impeller 130 and lowering the power and/or energy required to generate pressure. It can be appreciated that as suction pressure increases by rotation of the impeller 130, the fluid flow through the flush circuit 185 will also increase. The configuration and geometry of the hub vanes 146 will increase the fluid flow by drawing liquid through the flush circuit 185 and into the hub fluid channels 148 and push the fluid through the directional thrust balance openings 152. This fluid flow will induce rotation of the impeller 130 by propelling it.

It can be appreciated that torque can be applied to impeller 130 in a plurality of different manners. In an example embodiment, a drive carrier 190 is rotated by a drive shaft 192 or by any other means. The drive carrier 190 has affixed thereto one or more magnetic materials or magnets 193, so that magnetic material(s) 193 rotate with the drive carrier 190. The impeller 130 has one or more magnets or magnetic materials 194 affixed thereto such that as the drive carrier 190 is rotated it induces the impeller 130 to rotate by the attraction between magnets and magnetic materials 193, 194. Other means to rotate the impeller 130 are contemplated.

According to an example embodiment, the impeller hub 140 has a length L of about 4-6 inches preferably about 5 inches, the interior hub wall 142 has a diameter of about 2 inches, the exterior hub wall 144 has a diameter of about 4.3 inches, and the hub vanes 146 have a width (height) of about one inch and a thickness as low as about 0.12 inches to as high as about 0.3 inches thick, preferably about 0.25 inches thick. The example impeller embodiment has four to six hub vanes 146, preferably five hub vanes 146, forming four to six hub fluid channels 148, preferably five hub fluid channels 148. In this regard, four hub vanes 146 form four hub fluid channels 148, five hub vanes 146 form five hub fluid channels 148, etc. The curved hub vanes 146, in addition to facilitating the application of rotational force or energy to the impeller, strengthen and stiffen the impeller hub 140. Accordingly, the number and configuration (e.g., thickness, width, length, curvature, etc.) of the hub vanes 146 will depend upon design requirements and loads, and likely will vary depending upon design factors. All the foregoing dimensions and values provided in this paragraph are exemplary and should not limit or narrow the disclosure or the present invention as other dimensions, values, and configurations are contemplated.

In the example impeller embodiment, the hub vanes 146 have an angle A of twist or pitch (angle A between the hub longitudinal axis 143 (which is coincident with the impeller axis 135) and the hub vane 146) of about 10 degrees to about 30 degrees, preferably about 20 degrees. The example impeller embodiment further includes a single directional thrust balance opening 152 in communication with each of the hub fluid channels 148 where each directional thrust balance opening 152 has a diameter as low as 0.100 inches to as high as 0.38 inches, preferably about 0.125 inches. In the example impeller embodiment, the impeller portion 131 of the impeller 130 has a diameter of as low as about four (4) inches to as high as about thirteen (13) inches, preferably about eleven (11) inches and includes between four to six impeller blades 132, preferably five impeller blades 132, forming four to six impeller passageways 134, preferably five impeller passageways 134. In this regard, four impeller blades 132 form four impeller passageways 134, five impeller blades 132 form five impeller passageways 134, etc. In the preferred example impeller 130, there are five impeller blades 132 forming five impeller passageways and each hub fluid channel 148 communicates with a respective one of the impeller passageways 134 through one directional thrust hole opening 152. All the foregoing dimensions and values provided in this paragraph are exemplary and should not limit or narrow the disclosure or the present invention as other dimensions, values, and configurations are contemplated.

While certain embodiments and examples have been described, including certain details thereof, the impeller blades 132 and/or the impeller passageways 134 are not limited to the described embodiments and examples as different shapes, sizes, configurations, arrangements, geometry, or number of impeller blades 132 and/or impeller passageways 134 are contemplated. In addition, the hub vanes 146 and/or the hub fluid channels 148 formed by the one or more hub vanes 146 are not limited to the described embodiments, examples, or details as different shapes, sizes, configurations, arrangements, geometry, or number of hub vanes 146 and/or the hub fluid channels 148 formed by the one or more hub vanes 146 are contemplated. In addition, the directional thrust balance openings are limited to the described embodiments, examples, or details as different shapes, sizes, configurations, arrangements, geometry, angles, locations, or number of directional thrust balance openings 152 are contemplated. The manner or means of rotating the impeller should also not be limited to the described example as different means of rotating the impeller are contemplated. Furthermore, the manner and means by which fluid (e.g., secondary fluid 107 and/or working fluid 105) is delivered to the hub fluid channels 148 should not be limited to the disclosed embodiments or examples as different means of delivering fluid to the hub fluid channels 148 is contemplated. That is, the external passage 170, inside passage 172, outside passage 175, internal passage 180, and/or flush circuit 185, which delivery fluid to the hub fluid channels 148, also referred to as secondary fluid circuits or channels, can take different forms and can have different shapes, sizes, locations, configurations, arrangements, and/or geometry.

An impeller assembly is disclosed that includes in an embodiment an impeller housing having a housing inlet for receiving a working fluid and an impeller outlet for discharging the working fluid. The impeller assembly according to an embodiment further includes an impeller located within the impeller housing and configured to rotate relative to the impeller housing, the impeller having an impeller inlet for receiving the working fluid and a plurality of impeller blades forming a plurality of impeller passageways to receive the working fluid, wherein the impeller inlet is in communication with the plurality of impeller passageways and each of the plurality of impeller passageways have an impeller outlet for discharging the working fluid. According to an aspect, the impeller can further optionally include an impeller hub that has one or more hub vanes forming one or more hub fluid channels to receive secondary fluid, wherein at least one of the one or more hub vanes is angled relative to a hub longitudinal axis and the at least one angled hub vane extends along a length of the impeller hub. In a further aspect, the impeller can further optionally include one or more hub fluid channels in communication with at least one of the plurality of impeller passageways and at least one of the hub fluid channels is configured to induce rotation of the impeller.

In an approach, at least one of the angled hub vanes includes a plurality of angled hub vanes and wherein the plurality of angled hub vanes are configured together with the one or more hub fluid channels so that the secondary fluid flows through the one or more hub fluid channels in a manner to facilitate rotating the impeller relative to the impeller housing. In a configuration, the one or more hub vanes strengthen and/or stiffen the impeller hub. It is preferred that the impeller outlet discharges the working fluid in a radial direction (e.g., circumferentially out of the impeller outlets). In a further preferred configuration, the one or more hub fluid channels are in communication with at least one of the plurality of impeller passageways. In a further embodiment, each one of the one or more hub fluid channels are in communication with at least a respective single one of the plurality of impeller passageways. In an alternative approach, multiple hub fluid channels are in communication with a single one of the plurality of impeller passageways.

The one or more hub fluid channels in an embodiment each include a directional thrust balance opening to direct the secondary fluid into at least one of a group consisting of: at least one of the plurality of impeller passageways, an impeller housing chamber, and combinations thereof, and further in an embodiment, at least one of the directional thrust balance openings is angularly oriented and in communication with at least one of the plurality of impeller passageways. The at least one angularly oriented directional thrust balance opening can take many forms including a slot having a width and a length, a round hole having a diameter, or more complex shapes. The size of the angularly oriented directional thrust balance opening can be adjusted to meet various design parameters. In an aspect, the at least one angularly oriented directional thrust balance opening has an angular orientation that is less than 60 degrees, e.g., as low as 5 degrees and as high as 45 degrees, and in a further design consideration can have an angular orientation that substantially matches an angular orientation of the at least one angled hub vane. In a preferred approach, the at least one angularly oriented directional thrust balance opening is located adjacent an interior hub wall of the impeller hub.

According to a further configuration, the pump assembly can comprise a plurality of angled hub vanes and a plurality of hub fluid channels, wherein the plurality of angled hub vanes and the plurality of hub fluid channels are located about the circumference of the impeller hub. In an example embodiment, there are between 4-8 angularly oriented hub vanes, preferably 5-6 angularly oriented vanes, distributed about the circumference of the hub, and according to a further aspect the plurality of angled hub vanes extend from an interior (preferably circumferential) hub wall to an exterior (preferably circumferential) hub wall, and the plurality of hub fluid channels each comprise at least two angled hub vanes, the interior hub wall and the exterior hub wall. The plurality of hub fluid channels in an aspect is the same number as the plurality of impeller passageways. The at least one angled hub vane according to an example embodiment can have an angle relative to the longitudinal axis of the impeller hub of between about as low as 10 degrees and as high as about 30 degrees, more preferably about 20 degrees, and/or the one or more hub vanes extend substantially the length of the impeller hub. Each hub fluid channel in an embodiment of the pump assembly includes at least one of the angularly oriented directional thrust balance opening in an end wall of the impeller hub in communication with at least one of the plurality of impeller vane passageways. All the hub fluid channels in an aspect can include two angled hub vanes.

The impeller assembly according to an embodiment further includes at least one of a group to provide the secondary fluid to the one or more hub fluid channels, wherein the group consists of: a flush circuit, an external passage, an outside passage, an internal passage; or combinations thereof. In an aspect, the secondary fluid comprises a portion of the working fluid, although the secondary fluid can be separate and independent of the working fluid. In an aspect, the flush circuit receives at least a portion of the secondary fluid from at least one of a group consisting of: one or more of the impeller outlets, an impeller housing chamber, and combinations thereof, and provides the secondary fluid to the one or more hub fluid channels. In a further aspect, the flush circuit provides the secondary fluid to an interface between the impeller hub and one or more stationary components of the impeller assembly, and in an aspect can be part of a flush circuit.

The secondary fluid according to embodiments is provided to at least one of a group consisting of: one or more hub fluid channel entrances, along the length L of the one or more hub fluid channels, through an interior hub wall, through an exterior hub wall, and combinations thereof. The impeller assembly can also include a shaft configured to support the impeller hub for rotation, and in a further embodiment, the angled hub vanes extend in the direction of an axis of rotation associated with the shaft. The impeller receives torque to rotate the impeller relative to the impeller housing, and it is contemplated that torque can be supplied and/or received in a variety of numerous different ways.

The corresponding structures, materials, acts, and equivalents of all means or step plus function elements in the claims below are intended to include any structure, material, or act for performing the function in combination with other claimed elements as specifically claimed. The description of the embodiments of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The terminology used herein was chosen to best explain the principles of the embodiments, the practical application or technical improvement over technologies found in the marketplace, or to enable others of ordinary skill in the art to understand the embodiments disclosed herein. The embodiments and examples were chosen and described in order to best explain the principles of the disclosure and the practical application, and to enable others of ordinary skill in the art to understand the disclosure for various embodiments with various modifications as are suited to the particular use contemplated.

It will be clear that the various features of the foregoing systems and/or methodologies may be combined in any way, creating a plurality of combinations from the descriptions presented above.

What is claimed is:

1. An impeller assembly comprising:

an impeller housing having a housing inlet for receiving a working fluid and a housing outlet for discharging the working fluid; and an impeller located within the impeller housing and configured to rotate relative to the impeller housing, the impeller having an impeller inlet for receiving the working fluid, a plurality of impeller blades forming a plurality of impeller passageways in communication with the impeller inlet to receive the working fluid, and each of the plurality of impeller passageways have an impeller outlet for discharging the working fluid, wherein the impeller further comprises an impeller hub that has one or more hub vanes forming one or more hub fluid channels to receive secondary fluid, wherein at least one of the one or more hub fluid channels is in communication with at least one of the plurality of impeller passageways and is configured to induce rotation of the impeller hub.

2. The impeller assembly according to claim 1, wherein at least one of the one or more hub vanes is angled relative to a longitudinal axis of the impeller so that the secondary fluid bears against the at least one angled hub vane in a manner to facilitate rotating the impeller relative to the impeller housing.

3. The impeller assembly according to claim 2, wherein the at least one of the one or more of the hub vanes comprises a plurality of angled hub vanes and wherein the plurality of angled hub vanes are configured together with the one or more hub fluid channels so that the secondary fluid flows through the one or more hub fluid channels in a manner to facilitate rotating the impeller relative to the impeller housing.

4. The impeller assembly according to claim 1, wherein each one of the one or more hub fluid channels are in communication with at least a respective single one of the plurality of impeller passageways.

5. The impeller assembly according to claim 1, wherein multiple hub fluid channels are in communication with a single one of the plurality of impeller passageways.

6. The impeller assembly according to claim 1, wherein the one or more hub fluid channels each include directional thrust balance opening to direct the secondary fluid into at least one of a group consisting of: at least one of the plurality of impeller passageways, an impeller housing chamber, and combinations thereof, wherein the directional thrust balance opening is configured to induce rotation of the impeller.

7. The impeller assembly according to claim 6, wherein at least one of the directional thrust balance openings is angularly oriented and in communication with at least one of the plurality of impeller passageways.

8. The impeller assembly according to claim 7, wherein the at least one angularly oriented directional thrust balance opening is at least one of a group consisting of a slot having a width and a length, a round hole having a diameter, and combinations thereof.

9. The impeller according to claim 7, wherein the at least one angularly oriented directional thrust balance opening has an angular orientation that substantially matches an angular orientation of the at least one of the one or more angled hub vanes.

10. The impeller assembly according to claim 7, wherein the at least one angularly oriented directional thrust balance opening is located adjacent an interior hub wall of the impeller hub.

11. The impeller assembly according to claim 6, wherein each hub fluid channel comprises at least one of the angularly oriented directional thrust balance opening in an end wall of the impeller hub in communication with one of the plurality of impeller vane passageways.

12. The impeller assembly according to claim 1, wherein the at least one angled hub vane has an angle relative to the longitudinal axis of the impeller hub of between 10 degrees and 30 degrees.

13. The impeller assembly according to claim 1, further comprising at least one of a group to provide the secondary fluid to the one or more hub fluid channels, wherein the group consists of at least one of: a flush circuit, an external passage, an outside passage, an internal passage, and combinations thereof.

14. The impeller assembly according to claim 13, further comprising the flush circuit, wherein the flush circuit receives at least a portion of the secondary fluid from at least one of a group consisting of: one or more of the impeller outlets, an impeller housing chamber, and combinations thereof, and provides the secondary fluid to the one or more hub fluid channels.

15. The impeller assembly according to claim 13, wherein the flush circuit provides the secondary fluid to an interface between the impeller hub and one or more stationary components of the impeller assembly.

16. The impeller assembly according to claim 1, wherein the secondary fluid is provided to at least one of a group consisting of: one or more hub fluid channel entrances, along a length L of the one or more hub fluid channels, through an interior hub wall, through an exterior hub wall, and combinations thereof.

17. The impeller assembly according to claim 1, further comprising a shaft configured to support the impeller hub for rotation and the hub vanes extend in the direction of an axis of rotation associated with the shaft.

18. An impeller assembly comprising:

an impeller housing having a housing inlet for receiving a working fluid and a housing outlet for discharging the fluid; and an impeller located within the impeller housing and configured to rotate relative to the impeller housing, the impeller having an impeller inlet for receiving the working fluid, a plurality of impeller blades forming a plurality of impeller passageways in communication with the impeller inlet to receive the working fluid, and each of the plurality of impeller passageways have an impeller outlet for discharging the working fluid, wherein the impeller further comprises an impeller hub that has one or more hub vanes forming one or more hub fluid channels to receive secondary fluid and one or more hub fluid channels are in communication with at least one of the plurality of impeller passageways and at least one of the hub fluid channels includes at least one of a group configured to induce rotation of the impeller consisting of: the one or more hub vanes being angled relative to a longitudinal axis of the impeller, one or more angularly directional thrust balance openings, and combinations thereof.

19. The impeller assembly of claim 18, wherein the one or more hub fluid channels comprises at least one directional thrust balance opening configured to direct the secondary fluid into at least one of a group consisting of: at least one of the plurality of impeller passageways, an impeller housing chamber, and combinations thereof.

20. The impeller assembly of claim 19, wherein the at least one directional thrust balance opening is angularly oriented with respect to at least one of the plurality of impeller passageways.

* * * * *